US005909165A

United States Patent [19]

Leupold

[11] Patent Number: 5,909,165

[45] Date of Patent: Jun. 1, 1999

[54] CHIRON TWISTER

[75] Inventor: Herbert A. Leupold, Eatontown, N.J.

[73] Assignee: The United States of America as represented by the Secretary of the Army, Washington, D.C.

[21] Appl. No.: 08/920,736

[22] Filed: Aug. 29, 1997

[51] Int. Cl.[6] ..... H01F 7/02

[52] U.S. Cl. ..... 335/210; 335/302; 335/306; 315/5.35; 372/2

[58] Field of Search ..... 335/210, 302–306; 315/5.34, 5.35; 372/2; 250/396 ML

[56] References Cited

U.S. PATENT DOCUMENTS

| | | | |
|---|---|---|---|
| H1615 | 12/1996 | Leupold . | |
| 3,233,587 | 2/1966 | Morton | 335/302 |
| 3,562,683 | 2/1971 | De Santis et al. | 315/5.35 |
| 4,764,743 | 8/1988 | Leupold et al. . | |
| 4,906,877 | 3/1990 | Ciaio | 310/11 |
| 4,994,778 | 2/1991 | Leupold . | |
| 5,068,860 | 11/1991 | Hartemann et al. | 372/2 |
| 5,079,458 | 1/1992 | Schuster | 310/12 |
| 5,099,217 | 3/1992 | Leupold . | |

OTHER PUBLICATIONS

R. H. Jackson et al., "The Coaxial Hybrid Iron Wiggler", Nuclear Instrumentation Methods, Physics Research, vol. A (1994).

H.A.Leupold, "Augmentation of Field Uniformity and Strength in Spherical and Cylindrical Magnetic Field Sources", 70 Journal of Applied Physics No. 2, p. 6621 (1991).

*Primary Examiner*—Michael L. Gellner
*Assistant Examiner*—Raymond Barrera
*Attorney, Agent, or Firm*—Michael Zelenka; George B. Tereschuk

[57] ABSTRACT

A Chiron Twister magnet structure is provided from a right circular cylinder constructed of a passive material, such as iron, formed into a continuous helical bar deployed around a tunnel-like working space, in which it produces a transverse helical magnetic field, and through which a charged particle beam is sent by an electron beam means, causing the electrons to move in a helical pattern. The continuous helical bar is coupled to an external magnetic field means. The continuous helical bar has a substantially rectangular cross section, with a plurality of south poles opposed by a plurality of north poles. The continuous helical bar may be constructed of a circular right cylinder, such as a pipe, made of iron, or any other high saturation passive magnetization material.

9 Claims, 4 Drawing Sheets

CHIRON TWISTER

RELATED APPLICATION

U.S. patent application Ser. No. 08/920,237, entitled "PERMANENT MAGNETIC TWISTER," which has been partially assigned to the same assignee, has been filed in the United States Patent and Trademark Office and is related to this application.

GOVERNMENT INTEREST

The invention described herein may be manufactured, used and licensed by or for the Government of the United States of America without the payment to me of any royalties thereon.

BACKGROUND OF THE INVENTION

1. Field of the Invention

The present invention relates in general to magnet designs. More particularly, the present invention relates to a magnet structure providing a Chiron Twister that produces a magnetic field capable of causing an electron to have a helical trajectory.

2. Description of the Prior Art

Magnetic fields are commonly used in the operation of numerous electronic devices, including those which accelerate and focus electrons in a free electron laser. Such magnetic fields are generated by large mass, current driven systems typically comprised of a solenoid, an external power source and a means for cooling the coils of the solenoid. One significant disadvantage of such conventional systems, however, is that they are large, expensive and energy-intensive.

The foregoing disadvantages are apparent when conventional electromagnetic apparatus are used to operate a free electron laser. A free electron laser typically has a passageway, which is often an excavated cylindrical space, through which an electron beam can pass. This passageway can be comprised of hard ferromagnetic material, i.e. permanent magnets, or it can be an iron Chiron Wiggler, which is a well-known type of free-electron laser structure affording much shorter magnetic periods than usual in such devices. The term "Chiron" is an abbreviation for Circular Hollow Iron, the material used to fabricate Chiron-type magnetic devices. References on Chiron Wigglers include R. H. Jackson et al., "The Coaxial Hybrid Iron Wiggler," Nuclear Instrumentation Methods, Physics Research, Vol. A (1994) and Leupold, Statutory Invention Registration No. H1615, entitled, "Magnetic Fields For Chiron Wigglers," issued on Dec. 3, 1996. In a Chiron Wiggler, an externally mounted solenoid can create an axial magnetic field along the length of the passageway. This axial field then saturates the passageway's material, i.e. iron, to induce a transverse magnetic field alternating in direction with displacement along the length of the passageway. Such a transverse field would accelerate and cause the electrons to oscillate circumferentially as they pass longitudinally along the passageway.

Wigglers accelerate electrons, so that they radiate energy, the frequency of which depends on the strength and periodicity of the magnetic field. However, the radiation produced by an electron beam oscillating in an alternating field is of a wave length commensurate with the period of the magnetic field, so that for short wavelengths it becomes difficult to space magnets sufficiently thin to operate and attain sufficient field strength for accelerating the electrons.

This "tyranny of size" may be somewhat overcome by using relativistic electrons which "see" a magnet structure that shrinks with increasing electron energy. While such an arrangement works, it still requires massive equipment generating the high voltage needed to impart sufficient energy to the electrons to make them relativistic, which frustrates the goals of compactness and lightness. Until now, a permanent magnet structure addressing the long-felt problems of unattainably thin magnets of sufficient strength has been needed to simultaneously generate sufficient field strength and sufficiently short magnetic periods.

Many devices utilizing magnetic fields also need to provide a helically oriented transverse magnetic field. See, for example, Leupold, "Augmentation of Field Uniformity and Strength in Spherical and Cylindrical Magnetic Field Sources," 70 Journal of Applied Physics No. 2, p. 6621 (1991). Examples of such permanent magnetic devices include the structures found in Leupold, et. al., U.S. Pat. No. 4,764,743, entitled, "Permanent Magnet Structures For The Production of Transverse Helical Fields," issued on Aug. 16, 1988, Leupold, U.S. Pat. No. 4,994,778, entitled, "Adjustable Twister," issued on Feb. 19, 1991 and Leupold, U.S. Pat. No. 5,099,217, entitled, "Constant Gap Cladded Twister," issued on Mar. 24, 1992. Each of these references are incorporated herein by reference.

While these prior art structures all produce useful magnetic fields within a central working space, they are all relatively complex permanent magnet structures with numerous different magnets, making them disadvantageous in terms of complexity, weight and cost. Until now, the numerous advantages of the Chiron magnetic structures in the terms of electron acceleration and the desirable transverse helical magnetic fields of the magnetic twister have never been effectively combined to address the problems of higher field amplitudes and high power circularly polarized radiation, without suffering from the disadvantages of numerous complex magnetic pieces, high cost and excessive weight.

The present invention overcomes these disadvantages and offers numerous other advantages by conventional electromagnetic systems with a compact, light-weight and inexpensive Chiron Twister structure that provides the desired magnetic field and eliminates dependence on relatively expensive permanent magnets that are hard to fabricate and assemble. While the Chiron Wiggler's internal iron elements are saturated within the passageway to form a periodic pole distribution that creates a transverse sinusoidal magnetic field, the Chiron Twister forms a transverse helical field. The present invention addresses the problems of attaining higher field amplitudes in short periods, known as FEL's, for use in high power radiation sources by providing a source of high power circularly polarized radiation in a magnet structure comprising a Chiron Twister able to simultaneously generate both sufficient field strength and sufficiently short periods.

The present invention provides several embodiments of a simple, cost-effective and advantageous Chiron Twister structure providing the much-needed transverse helical magnetic fields that other magnet structures cannot provide, without any of the drawbacks, limitations and shortcomings of prior art magnetic structures in terms of complexity, cost and weight.

SUMMARY OF THE INVENTION

Accordingly, it is an object of the present invention to replace conventional electromagnetic systems with a compact, lightweight structure comprising a Chiron Twister that provides the desired transverse, helical magnetic field, thereby eliminating dependence on hard to manufacture and assemble permanent magnets.

An additional object of the present invention is to provide a Chiron Twister with a helical transverse magnetic field by advantageously employing a cylindrical magnetized iron pipe formed into a continuous helical bar that produces the desired transverse helical magnetic field and twice as much pole distribution as permanent magnets do, and thereby much larger magnetic fields, without any of the shortcomings, drawbacks and limitations of prior art magnetic structures.

To attain these and other objects and advantages, as well as resolving the long-standing shortcomings, drawbacks and limitations of current permanent magnetic structures that neither provide a much-needed transverse helical magnetic field nor do so in an economical and cost-effective manner, the Chiron Twister of the present invention provides a simple, inexpensive and compact magnetic structure comprising a magnetized right circular cylinder of iron, or another passive material, formed into a continuous helical bar coupled to a means for providing an external magnetic field, said continuous helical bar being deployed around a tunnel-like working space, through which an electron beam is sent that produces a transverse helical magnetic field.

BRIEF DESCRIPTION OF THE DRAWINGS

FIG. 4 top shows the helical iron bar of the present invention along with the saturating magnetic field (arrow) and the magnetic poles on the transverse surfaces of the iron bar. FIG. 4 bottom shows the magnetic pole distribution in the FIG. 4 top structure.

DETAILED DESCRIPTION OF THE DRAWINGS

Figure 1:
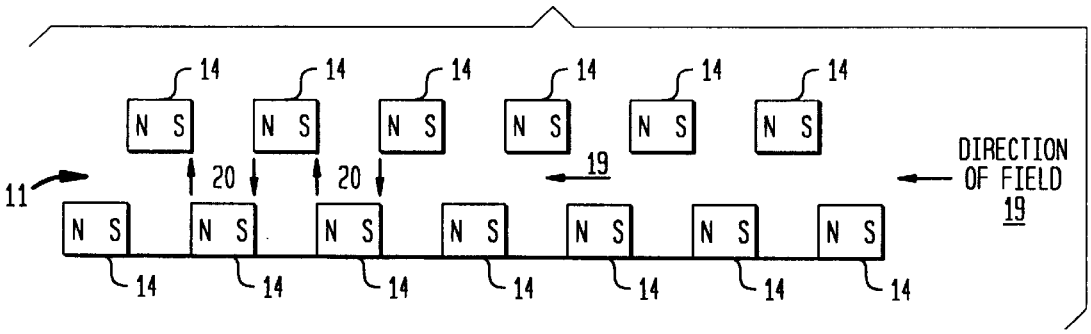
FIG. 1 is a cross section diagram illustrating the direction of the magnetic field of a prior art Chiron Wiggler.
Figure 2:
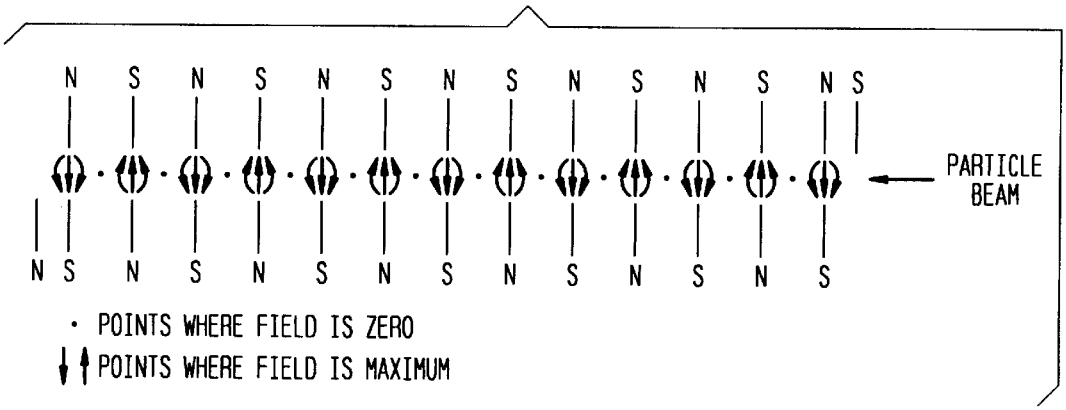
FIG. 2 is a diagram depicting the pole densities of the magnetic field and the axially alternating transverse field within the prior art Chiron Wiggler.

The Chiron Wiggler is a type of free-electron laser structure which affords periods that are much shorter than normally attained in such devices. Referring now to the drawings, in FIG. 1 there is depicted a cross section diagram illustrating the direction of the magnetic field of a prior art Chiron wiggler 13 shown in its simplest form, being comprised of two sets of iron vanes 14 displaced a half-period with respect to one another along tunnel 11, with a magnetic field having a direction 19. Assuming an infinite extension of FIG. 1 into and out of the paper, a magnetic field with said direction 19 is applied which saturates the iron vanes 14 as shown in FIG. 1 with vane thickness exaggerated in the interests of clarity. The poles pile up on the surfaces of the vanes 14, with the positive north poles on the surfaces away from the applied field 19 and the negative south poles on the surfaces facing toward the applied field 19. FIG. 2 illustrates the pattern of pole densities with arrows 20 of FIG. 1 representing the resulting axially alternating transverse field that causes an electron particle beam that passes through it to "wiggle" laterally to its axial motion.

In the FIG. 1 prior art Chiron wiggler arrangement, the wiggle causes acceleration, which, in turn, causes radiation. Of course, there is also flux flow between adjacent pole layers in the axial direction but there is still enough transverse field to suffice. In the prior art Chiron Wiggler arrangement, polar sources can be more closely spaced in the axial direction and produce the same field because iron has the higher saturization magnetization of $\leqq 23$ kG as compared to only about 13 kG for the best commercial permanent magnets. By contrast, in an ordinary wiggler, the poles cannot be so closely spaced without losing considerable field amplitude. Iron's higher saturization magnetization, which provides twice as much as pole distribution as permanent magnets do, and thereby much larger magnetic fields, is one of several advantageous features of the present invention.

Figure 3:
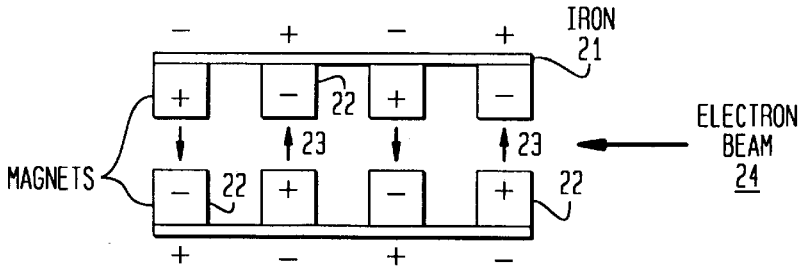
FIG. 3 shows a simplified form of a magnetic wiggler structure.

Referring now to FIG. 3, depicting a simplified form of a magnetic wiggler structure, iron structure 21 encloses a plurality of magnets 22 having magnetic lines of force 23 running perpendicular to, and opposing each other across the gap through which an electron beam 24 passes. Of course, no saturating external field is required because the array of flux sources consists of permanent magnets, however the periods must be longer due to the lesser magnetization of permanent magnets. It is noted that present invention's structure is constructed of a passive magnetic material, usually iron, with the term "passive" meaning any material having little or no coercivity.

Figure 4:
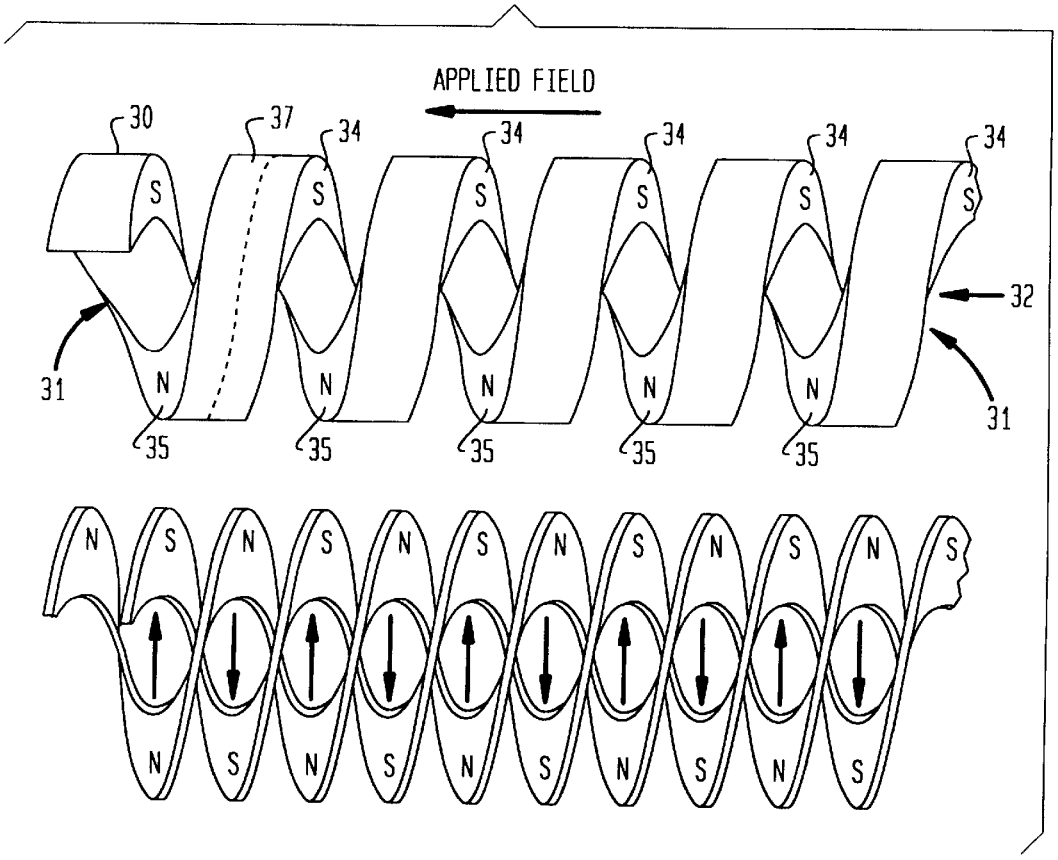
FIG. 4 shows the helical iron bar and associated magnetic pole distribution of the Chiron twister of the present invention.

Unlike the magnetic wiggler, the magnetic twister's magnetic field is constant in magnitude in the axial direction, but varies continuously in its azimuthal direction like a screw does. FIG. 4 depicts the helical iron bar magnetic structure of the present invention and its associated magnetic pole distribution. FIG. 4's top view shows the continuous helical iron bar of the present invention along with the saturating magnetic field and the magnetic poles on the transverse surfaces of the iron bar, while the FIG. 4 bottom view shows the magnetic pole distribution of the FIG. 4 top structure.

By way of illustration, if an iron nut with a square thread is placed in an axially applied saturating magnetic field, one can obtain polar distributions on the transverse walls of the thread similar to the FIG. 1 Chiron wiggler structure. The polar densities are then like helices wound in the same direction but spaced so that the axial distance between them is covered in the course of a half turn of the helix. As in the example of the iron nut within an axially applied saturating magnetic field, there will be magnetic flux leakage between the coils of the helices, but if the dimensions are chosen correctly so that the inner diameter of the thread is not much greater than the magnetic period of the twist, there will be sufficient lateral magnetic flux to supply the desired transverse field.

The FIG. 4 Chiron magnetic twister of the present invention is suitably dimensioned to produce sufficient lateral magnetic flux for supplying the desired transverse magnetic field. As depicted in FIG. 4 and described more fully within this specification, the inner diameter of the thread should not be much greater than the half period of the twist, and, if possible, the inner diameter of the thread should be smaller than the twist's half period.

Figure 5:
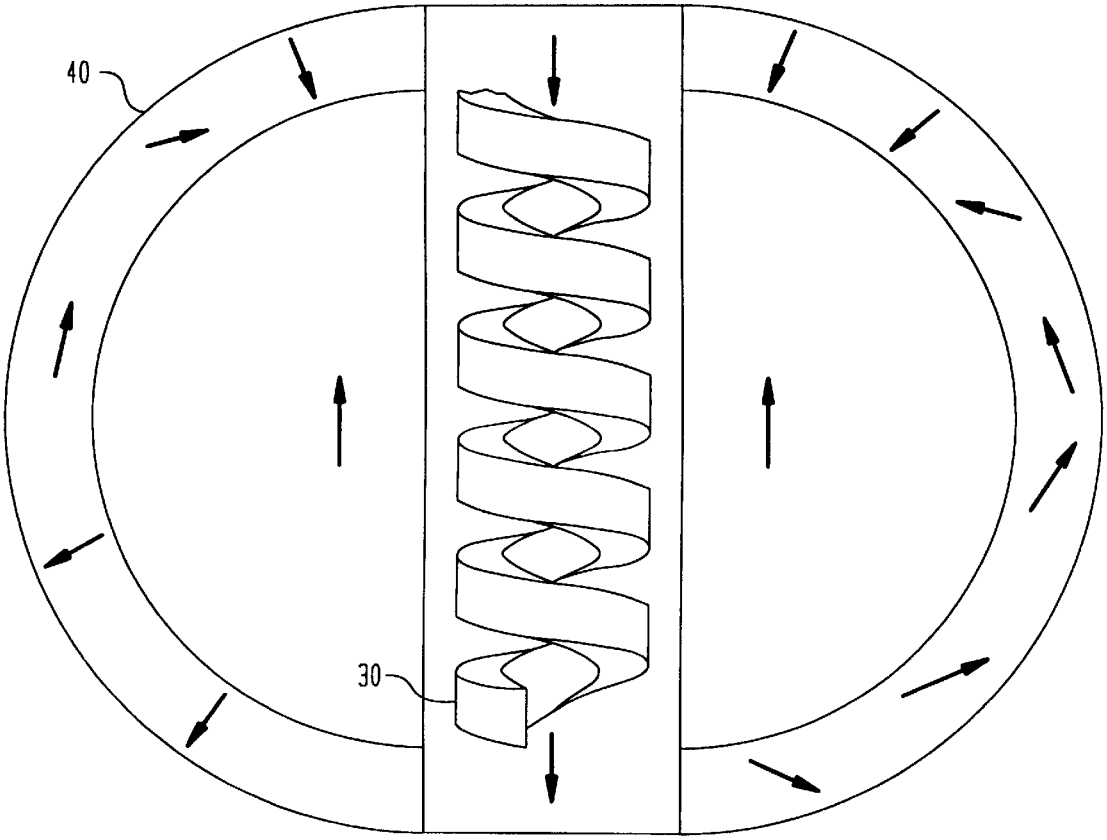
FIG. 5 shows the Chiron twister of the present invention within a means for providing an external magnetic field.

Applying these observations and still referring to FIG. 4, the present invention provides a Chiron Twister formed from a right circular cylinder constructed of a passive material, such as iron, into a continuous helical bar 30 deployed around a tunnel-like working space 31, in which it produces a transverse helical magnetic field, and through which a charged particle beam 32 is sent by a means for sending an electron beam. FIG. 5 depicts the continuous helical bar 30 of the present invention within a means for providing an external magnetic field 40, said external magnetic field means 40 being a magic sphere magnetic structure, however for the sake of clarity, the external magnetic field means 40 is not depicted in FIG. 4. It is also noted that FIG. 5 is not drawn to scale, but is merely illustrative. Referring again now to FIG. 4, there is depicted a continuous helical bar 30 formed from a circular right cylinder deployed around a tunnel-like working space 31, through which said electron beam means sends said charged particle beam 32. Said continuous helical bar 30 has a central longitudinal axis and a substantially rectangular cross section, having a plurality of south poles 34 opposed by a plurality of north poles 35. Said continuous helical bar 30 may be manufactured or formed by any conventional means, so long as it is constructed of a circular right cylinder, such as a pipe, made of iron or any other high saturation passive magnetization material. For example, an iron structure in the form of a cylinder or pipe that is magnetized in the longitudinal or axial direction could be cut to form said continuous helical bar 30. Maximum pole density, and hence maximum field, is attained when said continuous helical bar 30 is saturated.

Said continuous helical bar 30 has a right surface 34 and a left surface 35, and is fabricated and magnetized in such a way that magnetic south is on said right surface 34 and magnetic north is on said bottom surface 35. Said continuous helical bar 30 has a radial width, W, and an axial thickness, $T_1$, between said right surface 34 and said left surface 35. Spacing between a given imaginary point x and second parallel imaginary point y on said adjacent coils of said continuous helical bar 30 is coil spacing $T_2$. In order to produce sufficient lateral magnetic flux for supplying the desired transverse magnetic field provided by the structure of the present invention, said axial thickness $T_1$ is equal to said coil spacing $T_2$. Said radial width, W, said axial thickness $T_1$ and said coil spacing $T_2$, along with imaginary points x and y, are all depicted on FIG. 6. Referring back to FIG. 4, accordingly, the axial thickness $T_1$ is that distance along said longitudinal axis, in one-half turn of a coil of the helix. In this way, the north pole charge distribution is always diametrically opposed to the south pole distribution so that the desired transverse field at said longitudinal axis is maximized. The magnetic field produced by the device of the present invention has axial components at points not along said longitudinal axis. The structure of said continuous helical bar 30 helps focus said charged particle beam 32, usually electrons, traveling along, or in proximity, to said longitudinal axis. The device of the present invention accelerates the electrons of said charged particle beam 32 which causes the electrons to move in a helical pattern.

The transverse component of the magnetic field causes a circular motion to the charged particles of said charged particle beam 32, which when added vectroially to the axial translational motion, results in the advantageous helical trajectory provided by the device of the present invention. Since this motion has a rotary component, it involves an acceleration that causes the charged particle to radiate. When magnetic fields are properly commensurate with the coil spacing, laser action may form coherent radiation from all parts of the charged particle beam forming a power source of circularly polarized radiation. Properly commensurate means when the product of coil spacing in centimeters and the magnetic field in Tesla's is approximately equal to unity, or 1. It is noted that the magnetic fields produced according to the structure of the present invention compare favorably, and in some cases surpass, those of other, more complex and costly structures. It is also noted that the magnetic field in the central working space may be increased by increasing the radial width W of the helical bar, however, this may tend to add mass or weight to the structure and ceases to add significant field when W becomes greater than the coil spacing $T_2$.

In this device, the applied magnetic field saturates the iron material from which said continuous helical bar 30 is fabricated to form the polar distribution on the bar surfaces. This applied magnetic field also serves to focus the charged particle beam 32.

In FIG. 5, there is illustrated said continuous helical bar 30 of the present invention disposed within said external magnetic field means 40, which is a magic sphere magnetic structure, however the external magnetic field means 40 can be provided by a magic sphere, a solenoid or any other suitable arrangement.

Figure 6:
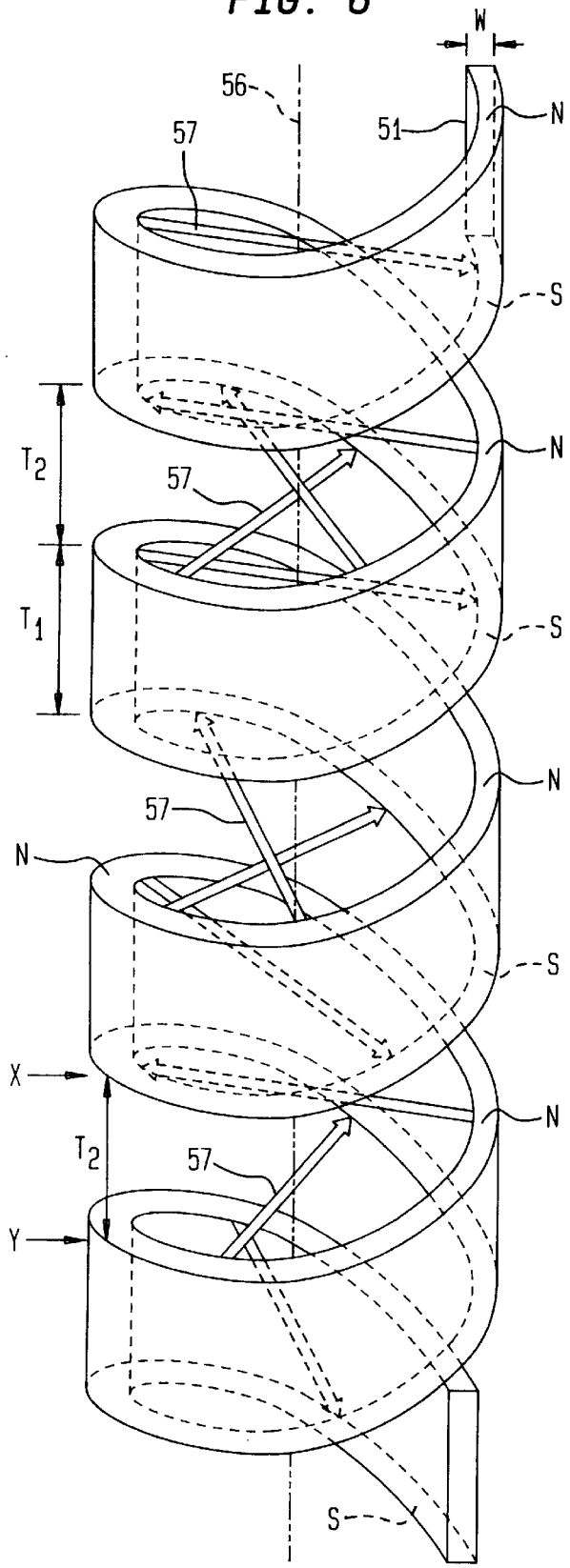
FIG. 6 depicts a cut-away perspective view of the Chiron twister of the present invention illustrating its internal transverse magnetic fields.

FIG. 6 is a vertical perspective view more clearly illustrating the magnetic field created by the helical magnet structure of FIG. 4. The continuous helical bar 51 has a north pole surface N and a south pole surface S. The continuous helical bar 51 has an axial thickness of $T_1$ and spacing between adjacent coils of $T_2$. A transverse magnetic field is created within the central working space formed by the continuous helical bar 51. The transverse magnetic field spirals or rotates as it progresses along the longitudinal axis 56, represented by a vertical dashed line, of the continuous helical bar 51. Arrows 57 illustrate the transverse magnetic field rotating around the longitudinal axis 56 of the continuous helical bar 51. In FIG. 6, the heads of the arrows 57 point to the south pole surface S, and the tails of the arrows 57 point to the north pole surface N. The transverse rotating magnetic field is formed between transversely diametrically opposed north pole surfaces N and south pole surfaces S of the continuous helical bar 51. Accordingly, the magnetic field will have a radial component and, for points not on the axis, an axial component perpendicular thereto as well.

It is understood that by the term electron beam is meant any charged particle beam. The sources of the charged particle beam can include an electron gun, a linear accelerator and so on. Variations of the device of the present invention include said electron beam means being an electron gun.

It will be understood that the embodiments described herein are merely exemplary and that a person skilled in the art may make many variations and modifications to the described embodiments utilizing functionally equivalent elements to those described. Any variations or modifications to the invention just described are intended to be included within the scope of said invention as defined by the appended claims.

What I claim is:

1. A Chiron magnet twister to accelerate electrons, causing the electrons to move in a helical pattern, comprising:

a magnetized right cylinder constructed of a passive magnetic material formed into a continuous helical bar defining a central working space;

said continuous helical bar, having a plurality of coils;

said continuous helical bar, having a central longitudinal axis, being coupled to a means for providing an external magnetic field;

said continuous helical bar, having a magnetic orientation along said central longitudinal axis;

said plurality of coils of the continuous helical bar produce a lateral magnetic flux to supply a transverse magnetic field; and said transverse helical magnetic field accelerates the electrons sent through said central working space from a means for sending an electron beam, causing the electrons to move in a helical pattern.

2. The Chiron magnet twister to accelerate electrons, as recited in claim 1, wherein:

said magnetized right circular cylinder is a pipe; and said passive magnetic material is iron.

3. The Chiron magnet twister to accelerate electrons, as recited in claim 2, further comprising:

said continuous helical bar having a rectangular cross section; and said rectangular cross section having an axial thickness along said central longitudinal axis.

4. The Chiron magnet twister to accelerate electrons, as recited in claim 3, further comprising:

said continuous helical bar having a right surface, a left surface and said central longitudinal axis;

said continuous helical bar having a radial width, W, and an axial thickness, $T_1$, between said right surface and said left surface;

said plurality of coils of the continuous helical bar having a coil spacing $T_2$ between a given imaginary point x and second parallel imaginary point y on each adjacent coil; and said axial thickness $T_1$ is equal to said coil spacing $T_2$ to produce a lateral magnetic flux for supplying said transverse helical magnetic field.

5. The Chiron magnet twister to accelerate electrons, as recited in claim 4, further comprising:

said right surface having a magnetic south pole charge; and said left surface having a magnetic north pole charge.

6. The Chiron magnet twister to accelerate electrons, as recited in claim 4, wherein:

said axial thickness $T_1$is that distance along said central longitudinal axis in one-half of a turn of each of said plurality of coils of the continuous helical bar;

said magnetic north pole charge of the left surface being diametrically opposed to said magnetic south pole charge of the right surface; and said transverse helical magnetic field at said central longitudinal axis is optimized.

7. The Chiron magnet twister to accelerate electrons, as recited in claim 6, wherein said electron beam means is an electron gun.

8. The Chiron magnet twister to accelerate electrons, as recited in claim 7, wherein said external magnetic field means is a magic sphere magnetic structure.

9. The Chiron magnet twister to accelerate electrons, as recited in claim 7, wherein said external magnetic field means is a solenoid.

* * * * *